US005590677A

United States Patent [19]

Kuroda

[11] Patent Number: 5,590,677

[45] Date of Patent: Jan. 7, 1997

[54] ELECTROPNEUMATIC POSITIONER

[75] Inventor: Masato Kuroda, Tokyo, Japan

[73] Assignee: Yamatake-Honeywell Co., Ltd., Tokyo, Japan

[21] Appl. No.: 492,904

[22] Filed: Jun. 20, 1995

[30] Foreign Application Priority Data

Jun. 24, 1994 [JP] Japan ..... 6-143223

[51] Int. Cl.[6] ..... F15B 5/00; F15B 13/16

[52] U.S. Cl. ..... 137/85; 251/129.09; 91/387

[58] Field of Search ..... 137/82, 85; 251/129.09; 91/387, 385, 386

[56] References Cited

U.S. PATENT DOCUMENTS

| | | | |
|---|---|---|---|
| 3,106,094 | 10/1963 | Gallo | 91/385 X |
| 3,771,541 | 11/1973 | Abbott | 137/85 |
| 4,336,819 | 6/1982 | Nishihara | 137/85 |
| 4,545,353 | 10/1985 | Gmelin et al. | 137/85 X |

FOREIGN PATENT DOCUMENTS

| | | | |
|---|---|---|---|
| 0093106 | 11/1983 | European Pat. Off. | 91/387 |
| 2658143 | 7/1978 | Germany | 137/85 |
| 2824952 | 12/1978 | Germany | 137/85 |
| 0163001 | 7/1988 | Japan | 137/85 |

*Primary Examiner*—Hoang Nguyen
*Attorney, Agent, or Firm*—Lane, Aitken & McCann

[57] ABSTRACT

An electropneumatic positioner includes an electropneumatic converter, an pilot relay, an operating unit, and a sensor. The electropneumatic converter includes a yoke having central and side leg portions, a permanent magnet arranged on the central leg portion, a pair of coils for exciting the side leg portions to have opposite polarities, a nozzle embedded in one side leg portion to spray air having predetermined pressure, a stopper arranged on the other side leg portion, and a flapper arranged to be swingable on a fulcrum near the central leg portion and serving to change a nozzle back pressure by controlling the amount of air sprayed from the nozzle in accordance with a swing. The electropneumatic converter receives a duty signal, as a driving signal for the coils, which signal is obtained by converting a deviation between an input signal and a feedback signal into a duty. The flapper is set to be parallel to the yoke when the deviation between the input signal and the feedback signal is zero. The pilot relay receives a nozzle back pressure and amplifies an air pressure. The operating unit converts an output air pressure from the pilot relay into a mechanical displacement amount. The sensor detects the displacement amount obtained by the operating unit and generates a feedback signal.

6 Claims, 6 Drawing Sheets

ELECTROPNEUMATIC POSITIONER

BACKGROUND OF THE INVENTION

The present invention relates to an electropneumatic positioner for controlling the operating shaft of a control valve used for various plants, e.g., a petrochemical plant and a chemical industry plant, to a position corresponding to an input signal with an air pressure converted from the input signal.

In general, in a plant such as a petrochemical plant, an automatic regulating valve for regulating the flow rate of an explosive gas cannot be directly driven by an electrical signal. For this reason, an electrical signal is converted into a pneumatic signal, and the automatic regulating valve is operated by this pneumatic signal.

As shown in FIG. 2, an electropneumatic positioner of this type which is used as a valve positioner for controlling the operating shaft of an automatic regulating valve is designed such that a deviation e between an electrical signal I0 (e.g., 4 mA to 20 mA) and a feedback signal is converted into duty to obtain a duty signal (pulse signal), and the duty signal is converted into a pneumatic signal to finally obtain a predetermined output air pressure Pn.

FIG. 2 shows the operation principle of the valve positioner. Reference numeral 1 denotes an arithmetic unit constituted by a CPU (Central Processing Unit) to which the electrical signal I0 is input via an input section 6; 2, a digital electropneumatic converter which has a nozzle/flapper mechanism and is driven by a duty signal constituted by a pulse string and output from the arithmetic unit 1; 3, a high-gain pilot relay for amplifying a nozzle back pressure PN of the nozzle/flapper mechanism and outputting the resultant value as the output air pressure Pn to an operating unit 4A of an automatic regulating valve 4; and 5, a sensor for detecting an actual operating quantity X and feeding back it as an electrical signal to the arithmetic unit 1. The arithmetic unit 1 obtains the deviation e between the electrical signal I0 and the detection signal from the sensor 5, and inputs a duty signal (pulse signal) to the electropneumatic converter 2, which signal is obtained by converting the deviation e into a duty, thereby making the nozzle and flapper of the flapper mechanism balance a force based on the electrical signal I0. FIG. 3 shows the relationship between the deviation e of the signal and the duty of the signal. When the deviation e of the signal is zero (signal of 0%), the duty of the signal is 50%.

FIG. 4 shows the detailed arrangement of a conventional valve positioner. Referring to FIG. 4, reference numeral 10 denotes an operating shaft of the automatic regulating valve 4; and 11, an electropneumatic positioner having a housing 12 fixed to one side of a yoke (not shown), which is mounted on the automatic regulating valve 4, with screws via a bracket and the like. A feedback mechanism 13 for feeding back the motion of the operating shaft 10 to the electropneumatic converter 2 is arranged in the housing 12 having an explosion-proof structure. A feedback lever 14 of the feedback mechanism 13 has an inner end, which is located in the housing 12, pivotally supported by a shaft 15 and swingably extends from the housing 12 to the operating shaft 10. The outer end of the feedback lever 14, which extends from the housing 12, is coupled to the operating shaft 10 with an elongated hole 16 and a pin 17. The feedback mechanism 13 comprises a span arm 21 which has one end pivotally supported by a pivot shaft 18 and is coupled to a flapper 20 via a feedback spring 19, a span adjusting screw 22 mounted on the span arm 21, a feedback plate 23 mounted on the shaft 15 of the feedback lever 14, a plate contact member 24 mounted on the span adjusting screw 22 to be vertically movable and having a distal end brought into contact with the feedback plate 23, and the like. When the span adjusting screw 22 is rotated to move the plate contact member 24 vertically along the span adjusting screw 22, the force of the feedback spring 19 changes to perform span adjustment (to be described later).

The housing 12 incorporates the electropneumatic converter 2 shown in FIG. 2 and constituted by a nozzle/flapper mechanism 27 and a magnetic unit 28. The magnetic unit 28 of the electropneumatic converter 2 is driven by a duty signal input from the arithmetic unit 1 to cause the flapper 20 to swing on a fulcrum 30. When the flapper 20 swings, the distance between the flapper 20 and a nozzle 31 arranged to be adjacent and opposite thereto changes. In other words, the back pressure PN of the nozzle changes. This nozzle back pressure PN is amplified by the pilot relay 3 to be output as a valve driving force. When the output air pressure Pn from the pilot relay 3 is applied to the operating unit 4A, the operating unit 4A displaces the operating shaft 10 of the automatic regulating valve 4 in the vertical direction. As a result, the valve opening degree of the automatic regulating valve 4 is controlled. The motion of the operating shaft 10 is received by the feedback lever 14 to be fed back to the nozzle/flapper mechanism 27 so as to stabilize the motion of the flapper 20.

The nozzle/flapper mechanism 27 comprises the flapper 20 having a central portion swingably supported on the fulcrum 30, and the nozzle 31 which is adjacent and opposite to one end of the flapper 20. One end of a zero point adjusting spring 33 which forms a zero point adjusting mechanism 32 on the opposite side to the nozzle 31 is coupled to the nozzle/flapper mechanism 27. The nozzle 31 is connected to an air source (not shown) via a supply air pipe 34. A constant supply air pressure $P_{sup}$ (normally 1.4 kgf/cm$^2$) is supplied from this air source to the nozzle 31. The pilot relay 3, a restrictor 35, a pressure reducing valve 36, a supply air pressure gauge (not shown), and the like are arranged midway along the supply air pipe 34.

The magnetic unit 28 comprises a yoke 38 fixed to a base 37, a pair of coils **39*a* and 39*b* arranged to be near and opposite to the two ends of the flapper 20, and a permanent magnet 40 arranged to oppose the central portion of the flapper 20. The yoke 38 has an E-shaped cross-section and includes three leg portions 38*a*, 38*b*, and 38*c*. The nozzle 31 is formed on the distal end of one side leg portion 38*a* to be adjacent and opposite to the flapper 20. A stopper 41 is arranged on the distal end of the other side leg portion 38*c*. The permanent magnet 40 is arranged on the distal end of the central leg portion 38*b*. As shown in FIG. 5, for example, the permanent magnet 40 is designed such that a side opposite to the flapper 20 is magnetized to the N pole, and the opposite side is magnetized to the S pole. Referring to FIG. 5, each solid arrow b indicates the direction of a magnetic field generated by the permanent magnet 40*a*; and each broken arrow a, the direction of a magnetic field generated by the coils 39*a* and 39*b*, which have the N and S poles as shown in FIG. 5, and flowing in a magnetic circuit constituted by the yoke 38 and the flapper 20. Note that the two coils 39*a* and 39*b*** are set to have opposite polarities.

Referring to FIG. 5, when the supply air pressure $P_{sup}$ of a constant pressure (e.g., 1.2 to 1.4 kg/cm$^2$) is supplied from the air source to the nozzle 31, and a duty signal D obtained by converting the deviation e into duty is supplied from the arithmetic unit 1 to the coils 39*a* dn 39*b*, a magnetic field is generated on the leg portion 38*a* side on the left side of the yoke 38 in the same direction as that of a magnetic field generated by the permanent magnet 40. In contrast to this, a magnetic field is generated on the leg portion 38*c* on the right side of the yoke 38 in a direction to cancel out the strength of the magnetic field generated by the permanent magnet 40. Consequently, a force F for attracting the flapper 20 increases on the left side and decreases on the right side. As a result, a counterclockwise rotational torque T proportional to the duty signal is generated in the flapper 20 around the fulcrum 30. The flapper 20 then swings/moves on the fulcrum 30 in the counterclockwise direction to reduce the gap between the nozzle 31 and the flapper 20. That is, the spraying resistance of the nozzle 31 is increased. As a result, the nozzle back pressure PN increases. This nozzle back pressure PN is amplified by the pilot relay 3 to generate a pneumatic signal proportional to the duty signal and apply the signal as the output air pressure Pn to the operating unit 4A of the automatic regulating valve 4.

FIG. 6 shows the relationship between the duty of a duty signal and the nozzle back pressure PN. As is apparent from FIG. 6, the nozzle back pressure PN increases in proportion to the duty. The electropneumatic converter 2 is driven by a coil current ON/OFF operation based on a pulse signal. The flapper 20 magnetically driven by this pulse signal does not perfectly comply with the signal and hence does not operation with 100% amplitude owing to the mass of the flapper 20, the support structure of springs, friction, and the like. The flapper 20 swings with about 50% of the integral value of a coil current when the deviation of the signal is 0, i.e., the duty of the signal is 50%.

Referring back to FIG. 4, the flapper 20 has almost the same length as that of the yoke 38, and the fulcrum 30 is arranged near the leg portion 38*b* of the yoke 38. Reference numeral 43 denotes a biasing spring means for biasing the flapper 20 toward the nozzle 31; 44, a cross-shaped spring for forming the fulcrum 30; and 45, a bracket.

The pilot relay 3 belongs to a bleed type because part of the supply air pressure $P_{sup}$ is always released to the atmosphere during a normal operation. The pilot relay 3 comprises a housing 54 partitioned into five chambers, i.e., an air supply chamber 49, an output chamber 50, an atmosphere release chamber 51, a bias chamber 52, and a nozzle back pressure chamber 53 by two diaphragms 47*a* and 47*b*, a partition 48, and the like, a piston 56 which is held by a poppet valve 55 and the diaphragms 47*a* and 47*b* and vertically moves, and the like. The air supply chamber 49 is connected to an air source (not shown) via the supply air pipe 34 and to the nozzle 31. The output chamber 50 communicates with the air supply chamber 49 via a communicating hole 58 formed in the partition 48 and can communicate with the atmosphere release chamber 51 via a hole 59 formed in the piston 56. The atmosphere release chamber 51 forms an exhaust chamber and communicates with the outside of the housing 54. The supply air pressure $P_{sup}$ is supplied to the bias chamber 52 via a pipe 62. The nozzle back pressure PN is supplied to the nozzle back pressure chamber 53 via a pipe 63. The poppet valve 55 retractably extends through the communicating hole 58 to open/close the communicating hole 58 and the hole 59 of the piston 56. The poppet valve 55 is biased by a spring 64 in a closing direction, i.e., in a direction in which the upper and lower valve bodies of the poppet valve 55 close the communicating hole 58 and the hole 59. Note that the biasing force of the spring 64 balances the nozzle back pressure PN.

Assume that this pilot relay 3 serves as a direct action type relay whose output increases with an increase in input. In this case, as the nozzle back pressure PN applied to the nozzle back pressure chamber 53 via the pipe 63 increases, the diaphragms 47*a* and 47*b* are displaced downward. For this reason, the piston 56 moves downward against the bias spring 64, and the poppet valve 55 also moves downward against the spring 64. As a result, the lower valve body of the poppet valve 55 separates from the communicating hole 58 of the partition 48 to allow the air supply chamber 49 to communicate with the output chamber 50. Consequently, the supply air pressure $P_{sup}$ supplied to the air supply chamber 49 via the supply air pipe 34 enters the output chamber 50 via the communicating hole 58, and the pressure in the output chamber 50 is supplied as a driving pressure Pout to the operating unit 4A via the pipe 60. In contrast to this, as the nozzle back pressure PN decreases, the poppet valve 55 moves upward owing to the biasing force of the spring 64. At this time, since the upper valve body of the poppet valve 55 separates from the opening portion of the lower end of the hole 59 of the piston 56 to cause the output chamber 50 to communicate with the atmosphere release chamber 51, the pressure in the output chamber 50 is released outside the housing 54 via the atmosphere release chamber 51.

FIG. 7 shows the relationship between the nozzle back pressure PN and the output air pressure Pn. As is apparent from FIG. 7, since the dynamic range of the nozzle back pressure PN supplied to the pilot relay 3 is very small, the high-gain pilot relay 3 outputs a pneumatic signal (output air pressure Pn) which allows the nozzle back pressure PN to cover the entire range of valve opening degree within a narrow range of about PN50. The duty of a signal corresponding to the narrow range of about PN50 as the nozzle back pressure PN is a narrow range of about 50%, as described with reference to FIG. 6. That is, unlike an analog positioner, a digital positioner must finely control the duty of a driving signal at around 50% throughout the entire opening degree of an automatic regulating valve. For this reason, as described above, the flapper 20 operates only within a narrow range of the integral values of coil currents, about 50%. As described above, the pilot relay 3 needs to have a high gain.

In the conventional electropneumatic converter 2 having the structure shown in FIGS. 4 and 5, a duty signal obtained by finely converting the deviation e into the duty of about 50% using the arithmetic unit 1 is supplied to the coils 39*a* and 39*b* to cause the flapper 20 to swing on the fulcrum 30 in a predetermined direction from a position where the flapper 20 is in contact with the stopper 41 and set in an inoperative state, thereby displacing the flapper 20 to positions corresponding to 0%, 50%, and 100% FS (Full Span). That is, the electropneumatic converter 2 is designed as follows. In an operation, the stopper 41 is moved backward from the position of the nozzle 31, and the flapper 20 is kept displaced while it is inclined to the right in FIG. 8 (0% deviation). When the nozzle 31 is completely closed, the flapper 20 becomes parallel to the yoke 38.

In the electropneumatic converter 2, examination of magnetic hysteresis curve characteristics obtained from magnetic flux density, magnetic field strength, residual magnetic flux density, coercive force, hysteresis, and the like reveals that the magnetic balances at the respective displacement positions based on the flapper 20, the coils 39*a* and 39*b*, and the permanent magnet 40 are stabilized while the flapper 20 is parallel to the yoke 38. That is, a magnetically balanced state is obtained when the left and right gaps of the magnetic circuit constituted by the flapper 20 and the magnetic unit 28 become equal to each other.

In the conventional electropneumatic converter shown in FIG. 8, however, magnetic balances at the flapper 20 and the like deteriorate during an operation, and the magnetic hysteresis is large. For this reason, if the electropneumatic converter is used in this state for a long period of time, a zero point shift may occur.

If such a zero point shift occurs, zero point adjustment must be performed again. Furthermore, in performing this zero point adjustment, the operator must open the housing 12 and adjust the biasing force of the zero point adjusting spring 33 with an adjusting means 70 while looking at an output pressure gauge. Moreover, in the zero point adjustment, an arbitrary duty signal (e.g., 0%, 50%, or 100%) is supplied to the coils 39*a* and 39*b*, and an output pressure at the corresponding position is adjusted to a normal numerical value. This method requires a cumbersome, complicated operation. In order to omit such zero point adjustment, therefore, some measures for preventing a zero point shift are required.

SUMMARY OF THE INVENTION

It is an object of the present invention to provide an electropneumatic converter which can ensure the magnetic balance of a flapper at a position near a duty of 50% to prevent occurrence of a magnetic hysteresis and a zero point shift due to a long-term operation, thereby realizing a stable operation.

It is another object of the present invention to provide an electropneumatic converter which requires no cumbersome zero point adjustment.

In order to achieve the above objects, according to the present invention, there is provided an electropneumatic positioner comprising an electropneumatic converter including a yoke having a central leg portion and a pair of side leg portions arranged on both sides of the central leg portion, the yoke having an E-shaped cross-section, a permanent magnet arranged on the central leg portion of the yoke, a pair of coils for exciting the side leg portions of the yoke to have opposite polarities, a nozzle, embedded in one of the side leg portions of the yoke, for spraying air having a predetermined pressure, a stopper arranged on the other side leg portion of the yoke, and a flapper, arranged to be swingable on a fulcrum near the central leg portion of the yoke to oppose the nozzle and the stopper, for changing a nozzle back pressure by controlling an amount of air sprayed from the nozzle in accordance with a swing, the electropneumatic converter receiving a duty signal, as a driving signal for the coils, which signal is obtained by converting a deviation between an input signal and a feedback signal into duty, and the flapper being set to be parallel to the yoke when the deviation between the input signal and the feedback signal is zero, amplification means for receiving a nozzle back pressure of the nozzle and amplifying an air pressure, air-mechanical conversion means for converting an output air pressure from the amplification means into a mechanical displacement amount, and sensor means for detecting the displacement amount obtained by the air-mechanical conversion means and generating a feedback signal constituted by an electrical signal.

DESCRIPTION OF THE PREFERRED EMBODIMENT

Figure 1A:
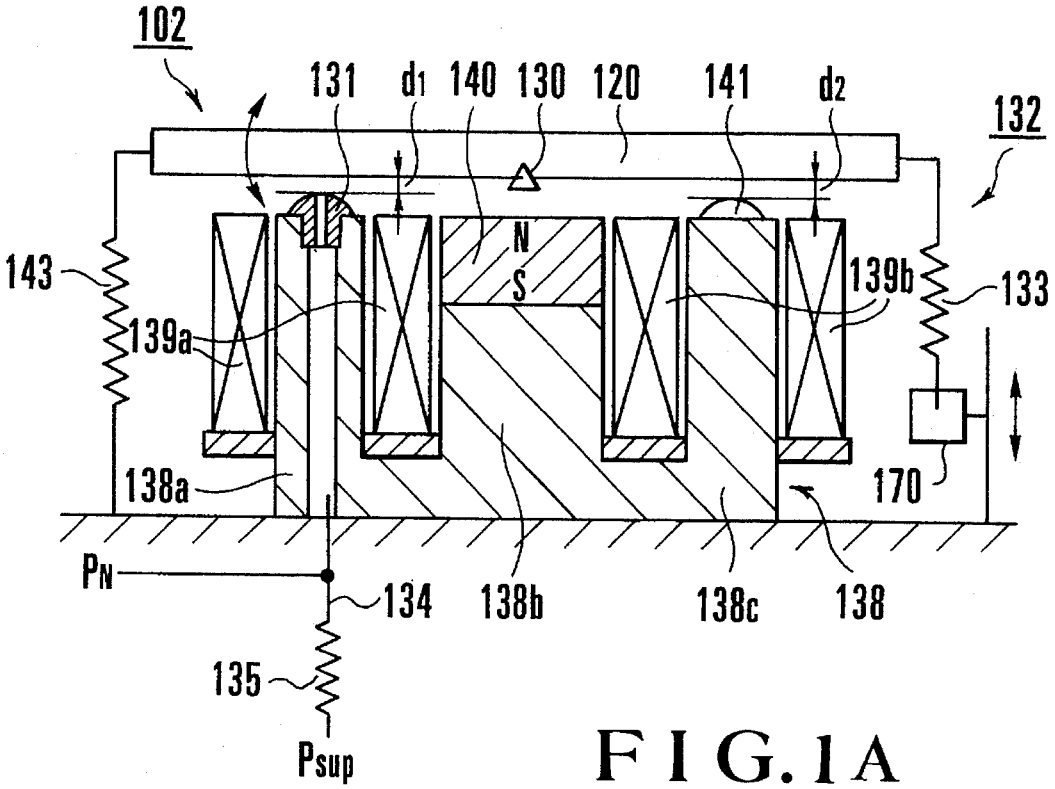
FIG. 1A is a sectional view showing the main part of an embodiment of an electropneumatic converter used for an electropneumatic positioner according to the present invention.
Figure 1B:
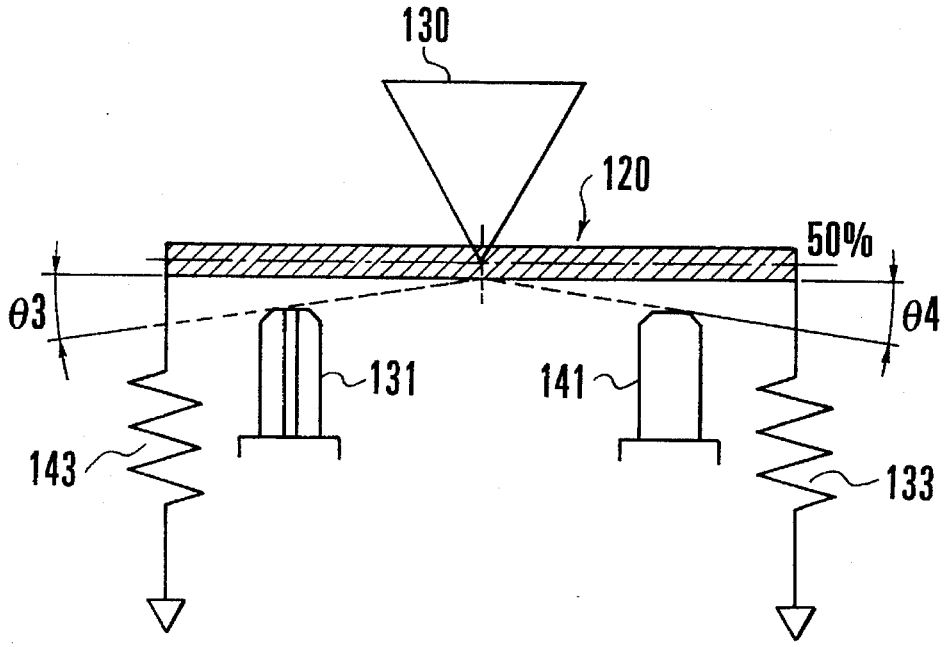
FIG. 1B is a view showing a state of the electropneumatic converter during an operation in FIG. 1A.

The present invention will be described in detail below with reference to the embodiment shown in the accompanying drawings. FIGS. 1A and 1B respectively show the arrangement of an electropneumatic converter used for an electropneumatic positioner according to the present invention and a state of the electropneumatic converter during an operation.

Figure 1C:
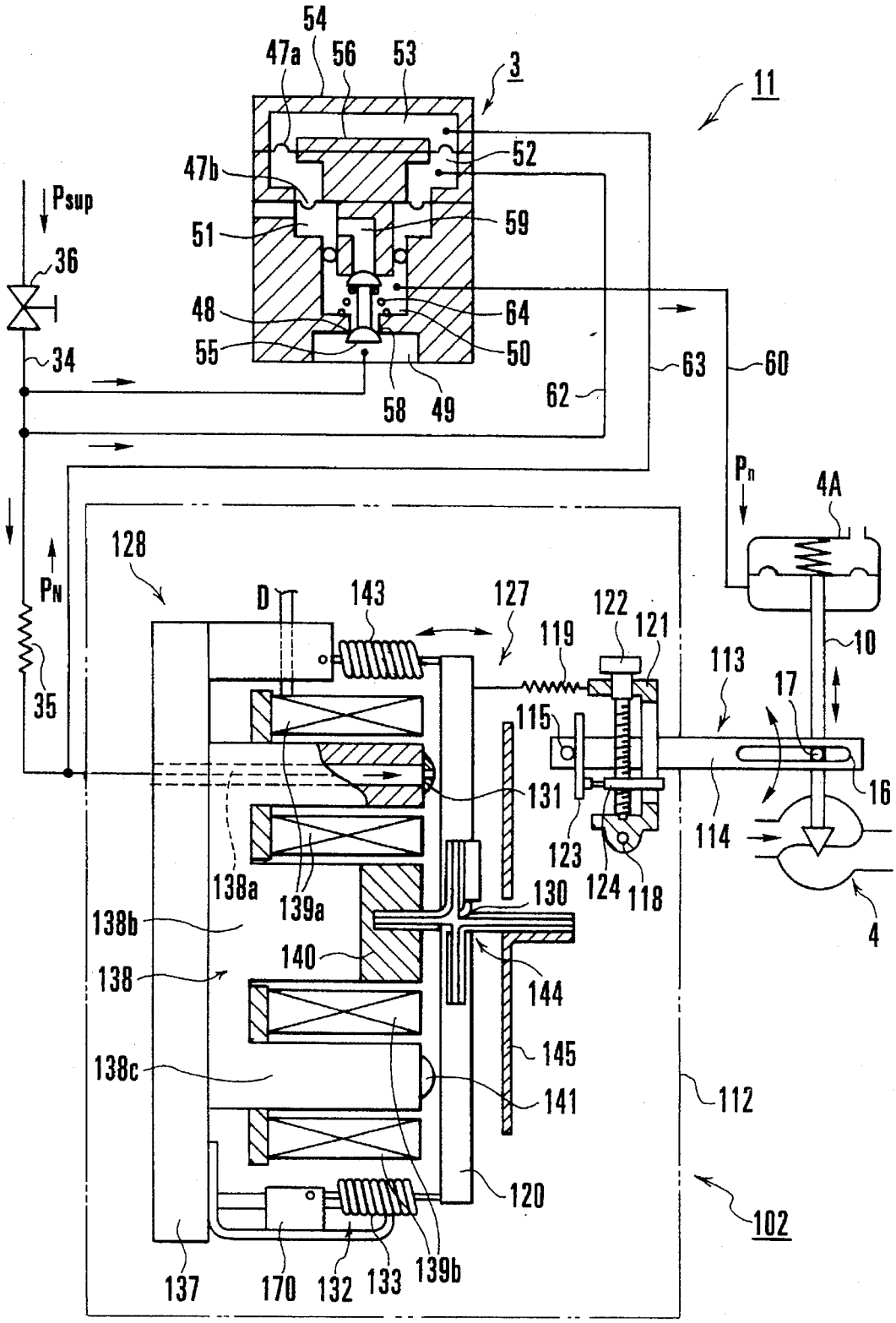
FIG. 1C is a view showing the overall arrangement of the electropneumatic positioner of the present invention.
Figure 2:
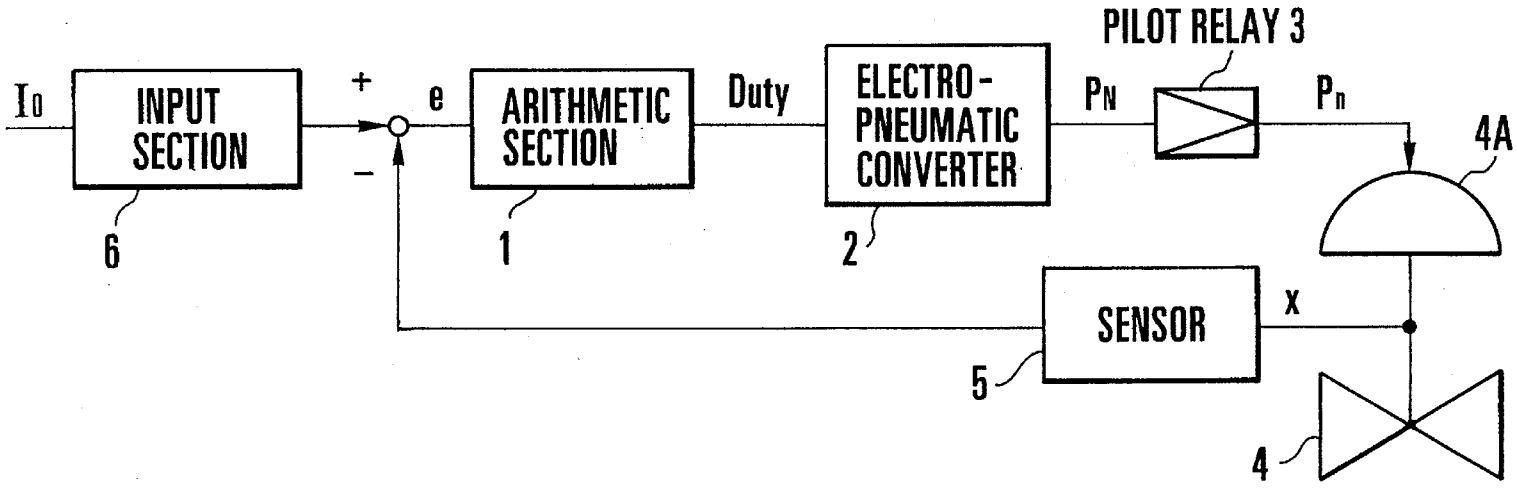
FIG. 2 is a block diagram showing the arrangement of an electropneumatic positioner common to the prior art and the present invention.
Figure 3:
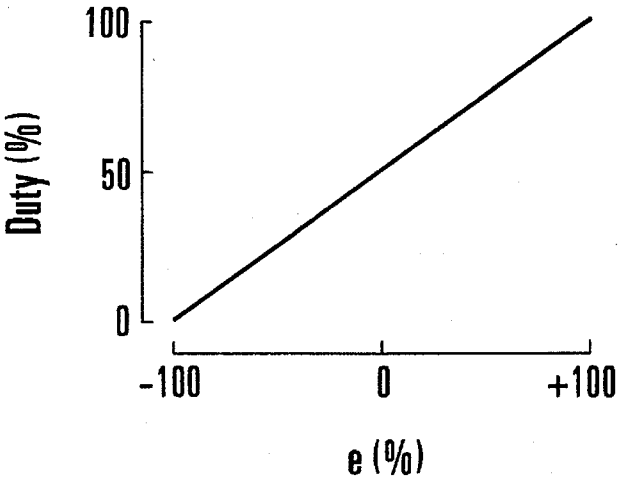
FIG. 3 is a graph showing the relationship between the deviation and duty of a signal.
Figure 4:
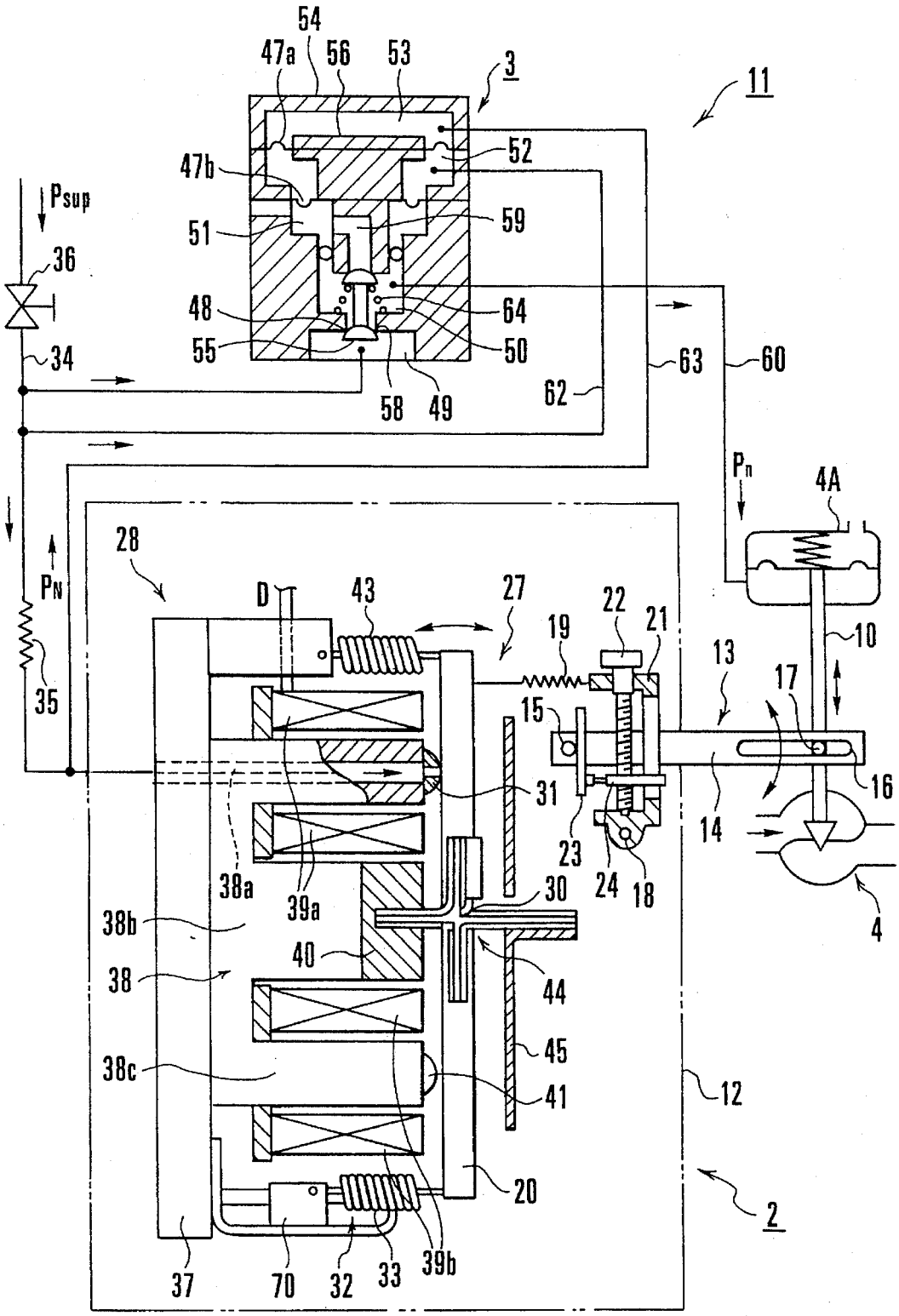
FIG.4 PRIOR ART
FIG. 4 is a sectional view showing the overall arrangement of an electropneumatic positioner common to the prior art and the present invention.
Figure 5:
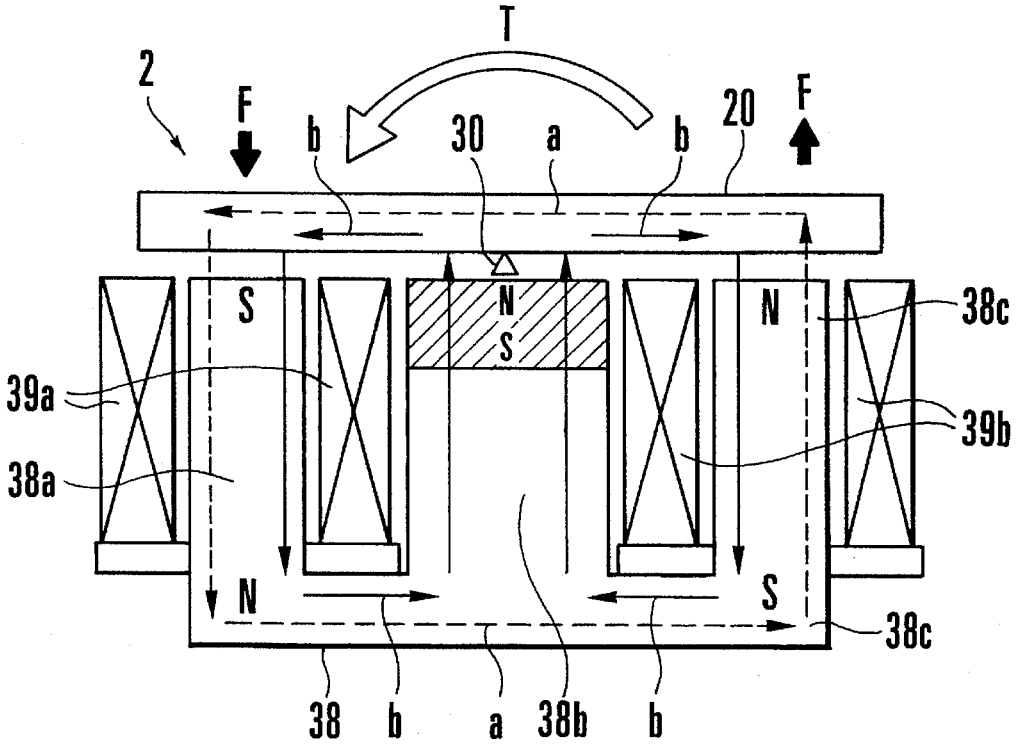
FIG. 5 is a sectional view of the eletropneumatic converter shown in FIG. 4.
Figure 6:
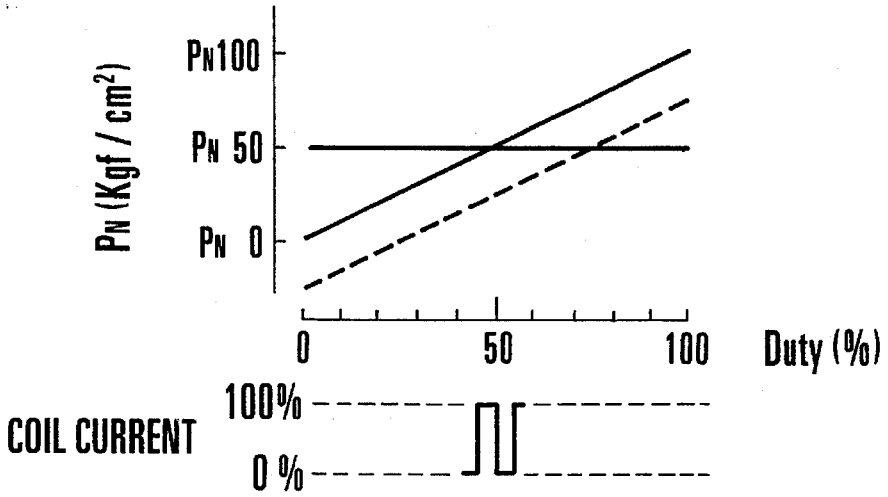
FIG. 6 is a graph showing the relationship between the duty of a signal and a nozzle back pressure.
Figure 7:
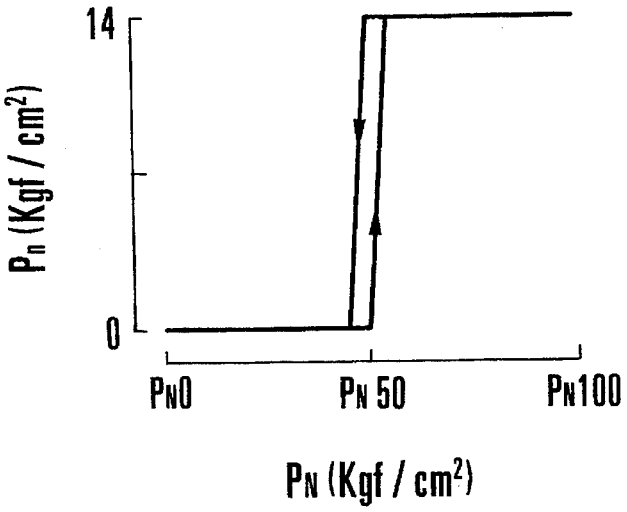
FIG. 7 is a graph showing the relationship between a nozzle back pressure and an output air pressure.
Figure 8:
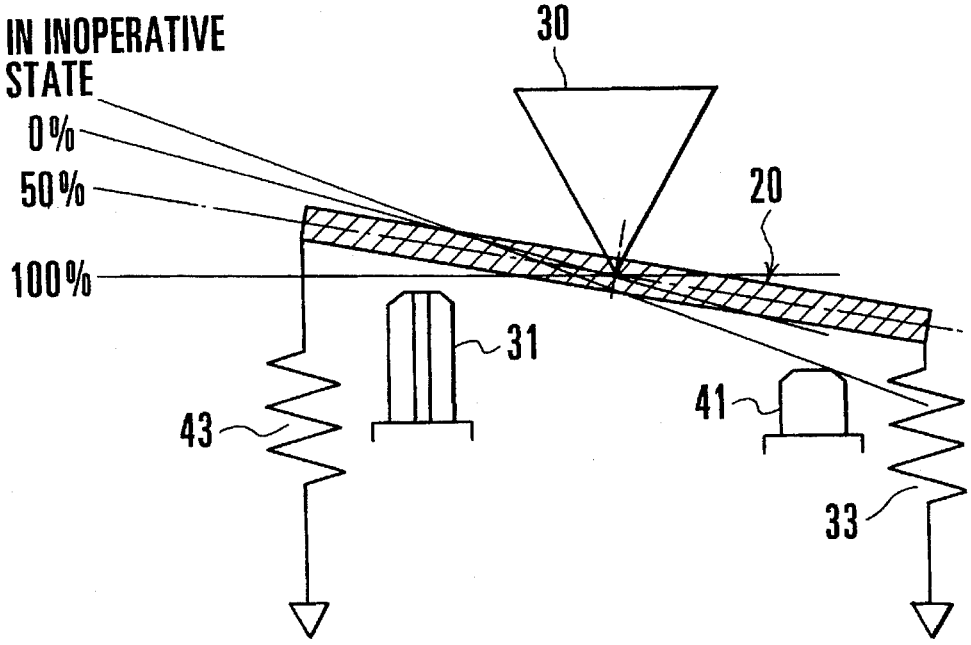
FIG.8 PRIOR ART
FIG. 8 is a view showing a state of a conventional electropneumatic converter during an operation.

FIG. 1C shows the overall arrangement of the electropneumatic positioner of the present invention. Since the arrangement of this electropneumatic positioner is the same as that shown in FIG. 4 except for the electropneumatic converter, the same reference numerals in FIG. 1 denote the same parts as in FIG. 4, and a description thereof will be omitted except for the electropneumatic converter. In addition, the arrangement of the electropneumatic positioner of the present invention is the same as that shown in FIG. 4. For this reason, a description of an arithmetic unit 1, a pilot relay 3, an automatic regulating valve 4, an operating unit 4A, a sensor 5, and an input section 6 will be omitted, and an electropneumatic converter 102 associated with a characteristic feature of the present invention will be described below.

Referring to the electropneumatic converter 102 shown in FIGS. 1A to 1C, an E-shaped yoke 138 has three leg portions 138*a* to 138*c*, and coils 139*a* and 139*b* are respectively arranged around the two side leg portions 138*a* and 138*c*. In addition, a nozzle 131 and a stopper 141, both of which oppose a flapper 120, are respectively arranged on the distal end faces of the two side leg portions 138*a* and 138*c*. A permanent magnet 140 is arranged on the distal end face of the central leg portion 138*b*, and a fulcrum 130 of the flapper 120 is arranged near the permanent magnet 140. The two side leg portions 138*a* and 138*b* are formed to have the same length to make the nozzle 131 and the stopper 141 equal in level. In addition, one or both of springs 133 and 143 is adjusted to make the flapper 120 parallel to the upper surface of the yoke 138, i.e., make the flapper 120 supported on the fulcrum 130 almost horizontal. With this adjustment, a distance d1 between the lower surface of the flapper 120 and the nozzle 131 is set to be equal to a distance d2 between the lower surface of the flapper 120 and a stopper 141. The nozzle 131 and the stopper 141 are at an equal distance when viewed from the fulcrum 130. For this reason, as shown in Fig. 1B, the maximum rotational angles of the flapper 120 in the left and right directions are equal (θ3=θ4), and the flapper 120 is brought into contact with the stopper 141. Note that the flapper 120 preferably has almost the same length as that of the yoke 138.

As described above, in the present invention, since the flapper 120 is set/held to be parallel to the yoke 138 when the deviation e of a signal is zero, the extension amount of the spring 143 at 0% FS is small, and hence the stress applied to the corresponding hook portion can be reduced.

A feedback mechanism 113 for feeding back the motion of the operating shaft 10 to the electropneumatic converter 102 is arranged in a housing 112 having an explosion-proof structure. The feedback mechanism 113 comprises a feedback lever 114, a span arm 121 which has one end pivotally supported by a pivot shaft 118 and is coupled to ta flapper 120 via a feedback spring 119, a span adjusting screw 122 mounted on the span arm 121, a feedback plate 123 mounted on a shaft 115 of the feedback lever 114, a plate contact member 124 mounted on the span adjusting screw 122 to be vertically movable and having a distal end brought into contact with the feedback plate 123, and the like. When the span adjusting screw 122 is rotated to move the plate contact member 124 vertically along the span adjusting screw 122, the force of the feedback spring 119 changes to perform span adjustment. Reference numeral 112 denotes the housing; 127, a flapper mechanism, 128, a magnet unit; 132, a zero point adjusting mechanism; 144, a cross-shaped spring; 145, a bracket; and 170, a biasing force adjusting means.

As described above, according to the present invention, since the flapper 120 is set to be almost parallel to the yoke 138 when the deviation e of a signal is zero (50% duty), the distance d1 between the flapper 120 and the nozzle 131 can be set to be almost equal to the distance d2 between the flapper 120 and the stopper 141. With this setting, the electropneumatic positioner can always be used in a magnetically balanced state. Even if, therefore, this apparatus is used for a long period of time, neither magnetic hysteresis nor zero point shift due to a magnetic hysteresis occurs, and cumbersome re-adjustment can be omitted.

As has been described above, according to the electropneumatic positioner of the present invention, the flapper can be held in a magnetically balanced state in which the flapper is parallel to the yoke during an operation. For this reason, even if this apparatus is used for a long period of time, neither magnetic hysteresis nor zero point shift due to a magnetic hysteresis occurs, and a stable operation can be realized, thereby omitting cumbersome re-adjustment.

What is claimed is:

1. An electropneumatic positioner comprising:

an electropneumatic converter including a yoke having a central leg portion and a pair of side leg portions arranged on both sides of the central leg portion, said yoke having an E-shaped cross-section, a permanent magnet arranged on the central leg portion of said yoke, a pair of coils for exciting the side leg portions of said yoke to have opposite polarities, a nozzle, embedded in one of the side leg portions of said yoke, and supplied with air having a predetermined pressure, a stopper arranged on the other side leg portion of said yoke, and a flapper, arranged to swing on a fulcrum near the central leg portion of said yoke to oppose said nozzle and said stopper, for changing a nozzle back pressure by controlling an amount of air supplied from said nozzle in accordance with the swing, an arithmetic means for obtaining a deviation between an input signal and a feedback signal from a sensor means, and for outputting to the coil a driving pulse signal with about 50% duty when the deviation is zero, and said flapper being set to be parallel to said yoke when the deviation between the input signal and the feedback signal is zero;

amplification means for receiving a nozzle back pressure of said nozzle and amplifying an air pressure to output an amplified air pressure to air-mechanical conversion means which converts the air pressure into a mechanical displacement amount;

sensor means for detecting the displacement amount obtained by said air-mechanical conversion means and generating a feedback signal constituted by an electrical signal, and wherein said nozzle and said stopper are set at the same level.

2. A positioner according to claim 1, wherein the distance between the fulcrum of said flapper and said nozzle is set to be equal to the distance between the fulcrum of said flapper and said stopper, and maximum swing angles of said flapper in two directions in which said flapper is brought into contact with said nozzle and said stopper are equal.

3. A positioner according to claim 1, wherein a pair of springs are provided for energizing both ends of the flapper respectively, and the flapper is set to be parallel with the yoke by adjusting at least one side of the spring.

4. An electropneumatic converter comprising:

a yoke having a central leg portion and a pair of side leg portions arranged on both sides of the central leg portion, said yoke having an E-shaped cross-section;

a permanent magnet arranged on the central leg portion of said yoke;

a pair of coils for receiving a duty signal as a driving signal and exciting the side leg portions of said yoke to have opposite polarities, the duty signal being obtained by converting a deviation between an input signal and a feedback signal into a duty;

a nozzle, embedded in one of the side leg portions of said yoke, and supplied with air having a constant pressure;

a stopper arranged on the other side leg portion of said yoke; and a flapper, arranged to swing on a fulcrum near the central leg portion of said yoke to oppose said nozzle and said stopper, for changing a nozzle back pressure by controlling an amount of air supplied from said nozzle in accordance with a swing, said flapper being set to be parallel to said yoke when the deviation between the input signal and the feedback signal is zero, and wherein said nozzle and said stopper are set at the same level.

5. A converter according to claim 4, wherein the distance between the fulcrum of said flapper and said nozzle is set to be equal to the distance between the fulcrum of said flapper and said stopper, and maximum swing angles of said flapper in two directions in which said flapper is brought into contact with said nozzle and said stopper are equal.

6. A converter according to claim 4, wherein a pair of springs are provided for energizing both ends of the flapper respectively, and the flapper is set to be parallel with the yoke by adjusting at least one side of the spring.

* * * * *